US008994491B2

(12) United States Patent
Kim et al.

(10) Patent No.: US 8,994,491 B2
(45) Date of Patent: Mar. 31, 2015

(54) CHIP RESISTOR AND METHOD OF MANUFACTURING THE SAME

(71) Applicant: Samsung Electro-Mechanics Co., Ltd., Suwon-si (KR)

(72) Inventors: Yong Min Kim, Suwon-si (KR); Jung Il Kim, Suwon-si (KR); Ichiro Tanaka, Suwon-si (KR); Young Tae Kim, Suwon-si (KR); Heun Ku Kang, Suwon-si (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/716,982

(22) Filed: Dec. 17, 2012

(65) Prior Publication Data

US 2014/0049358 A1 Feb. 20, 2014

(30) Foreign Application Priority Data

Aug. 17, 2012 (KR) ..... 10-2012-0090322

(51) Int. Cl.

| | |
|---|---|
| ***H01C 1/012*** | (2006.01) |
| ***H01C 7/00*** | (2006.01) |
| ***H01C 17/00*** | (2006.01) |
| ***H01C 17/065*** | (2006.01) |

(52) U.S. Cl.

CPC ..... *H01C 7/00* (2013.01); *H01C 17/006* (2013.01); *H01C 7/003* (2013.01); *H01C 17/065* (2013.01); *H01C 17/06526* (2013.01)

USPC ..... 338/309; 338/307; 338/334

(58) Field of Classification Search

CPC ..... H01C 17/006; H01C 7/003; H01C 17/06526; H01C 1/142; H01C 17/281; H01C 17/06546; H01C 17/283; H01C 17/288; H01C 1/034; H01C 7/18; H01C 1/01; H01C 3/12; H01C 1/012; H01C 1/14

USPC ..... 338/307, 309

See application file for complete search history.

(56) References Cited

U.S. PATENT DOCUMENTS

| | | | | |
|---|---|---|---|---|
| 5,680,092 | A * | 10/1997 | Yamada et al. | 338/309 |
| 5,907,274 | A * | 5/1999 | Kimura et al. | 338/309 |
| 6,297,564 | B1 * | 10/2001 | Chung | 257/783 |
| 2005/0085013 | A1 * | 4/2005 | Ernsberger et al. | 438/108 |
| 2009/0000811 | A1 | 1/2009 | Tsai | |

(Continued)

FOREIGN PATENT DOCUMENTS

| | | |
|---|---|---|
| CN | 101875831 A | 11/2010 |
| JP | 10-092602 | 4/1997 |

(Continued)

OTHER PUBLICATIONS

Notice of Office Action Korean Application No. 10-2012-0090322 dated Aug. 26, 2013.

Examination Report dated Jan. 24, 2014 issued in the corresponding Taiwanese Patent Application No. 101144682.

*Primary Examiner* — Kyung Lee

(74) *Attorney, Agent, or Firm* — McDermott Will & Emery LLP

(57) ABSTRACT

There are provided a chip resistor and a method of manufacturing the same. The chip resistor includes a ceramic substrate; an adhesion portion formed on a surface of the ceramic substrate; and a resistor formed on the adhesion portion, wherein the adhesion portion includes at least one of copper (Cu), nickel (Ni), and copper-nickel (Cu—Ni).

12 Claims, 5 Drawing Sheets

(56) References Cited

U.S. PATENT DOCUMENTS

| | | | | |
|---|---|---|---|---|
| 2009/0108986 | A1 | 4/2009 | Urano et al. | |
| 2011/0089025 | A1* | 4/2011 | Yang et al. | 204/192.21 |
| 2011/0234365 | A1* | 9/2011 | Yang et al. | 338/309 |
| 2013/0154790 | A1* | 6/2013 | Park et al. | 338/309 |
| 2014/0022691 | A1* | 1/2014 | Kwag et al. | 361/301.4 |

FOREIGN PATENT DOCUMENTS

| | | | |
|---|---|---|---|
| JP | 09-320802 | | 12/1997 |
| JP | 2001351803 | | 12/2001 |
| JP | 2010-114167 | A | 5/2010 |
| TW | 200523955 | A | 7/2005 |

* cited by examiner

CHIP RESISTOR AND METHOD OF MANUFACTURING THE SAME

CROSS-REFERENCE TO RELATED APPLICATIONS

This application claims the priority of Korean Patent Application No. 10-2012-0090322 filed on Aug. 17, 2012, in the Korean Intellectual Property Office, the disclosure of which is incorporated herein by reference.

BACKGROUND OF THE INVENTION

1. Field of the Invention

The present invention relates to a chip resistor and a method of manufacturing the same.

2. Description of the Related Art

As demand for miniaturized, lightweight electronic devices gradually increases, chip shaped electronic components are widely used in order to increase a wiring density of a circuit substrate.

With regard to a general resistor formed of a metal foil, the metal foil and a substrate may be adhered to each other via a resin material such as epoxy or the like.

In addition, with regard to a general resistor formed of a metal foil, an electrode is formed to have a clad structure or is formed via plating.

When a metal foil and a substrate are adhered to each other via a resin material, it may be difficult to transfer heat generated by the metal foil functioning as a resistor of a chip resistor to a material having excellent heat dissipation properties. Thus, heat generated by the chip resistor cannot be rapidly dissipated by the chip resistor. Heat generated by the chip resistor may increase a temperature of the resistor. In addition, a level of resistance can be changed due to an increase in temperature. When the chip resistor is used to detect current, the precision of the chip resistor as a resistor for detecting current may be reduced.

In addition, heat generated by the chip resistor may dissolve epoxy used for forming adhesives. Thus, a problem can arise in terms of the adhesion between the metal foil and the resistor.

When an electrode is formed to have a clad structure, it may be difficult to precisely control the thickness of the chip resistor.

When an electrode is formed via plating, since a current density of an edge of the electrode is increased, a thickness difference between the edge of the electrode and a central portion thereof can be generated. The difference in the thickness of the electrode may affect resistance and may reduce adhesion.

RELATED ART DOCUMENT (Patent Document 1) Japanese Patent Laid-Open Publication No. 2010-114167

(Patent Document 2) U.S. Patent Application Publication No. 2009-0000811

SUMMARY OF THE INVENTION

An aspect of the present invention provides a chip resistor having improved heat dissipation properties and a method of manufacturing the same.

Another aspect of the present invention provides a chip resistor including electrodes, thicknesses of which are precisely controlled and a method of manufacturing the chip resistor.

Another aspect of the present invention provides a chip resistor able to accurately adjust a target resistance and a method of manufacturing the chip resistor.

According to an aspect of the present invention, there is provided a chip resistor including: a ceramic substrate; an adhesion portion formed on a surface of the ceramic substrate; and a resistor formed on the adhesion portion, wherein the adhesion portion includes at least one of copper (Cu), nickel (Ni), and copper-nickel (Cu—Ni).

The resistor may include at least one of copper-nickel (Cu—Ni), copper-nickel-manganese (Cu—Ni—Mn), and nickel-chromium (Ni—Cr).

The chip resistor may further include an electrode formed on a surface of the resistor.

The chip resistor may further include an additional electrode formed on a surface of the electrode to precisely adjust resistance.

The chip resistor may further include a protective layer partially covering the resistor and the electrode.

According to another aspect of the present invention, there is provided a method of manufacturing a chip resistor, the method including: preparing a ceramic substrate; printing an adhesive paste including at least one of copper (Cu), nickel (Ni), and copper-nickel (Cu—Ni) on a surface of the ceramic substrate; and forming a resistor on an upper surface of the adhesive paste.

The resistor may include at least one of copper-nickel (Cu—Ni), copper-nickel-manganese (Cu—Ni—Mn), and nickel-chromium (Ni—Cr).

The method may further include forming an electrode by printing an electrode paste on a surface of the resistor.

The method may further include forming an electrode by printing an electrode paste on a surface of the resistor.

The method may further include firing the electrode.

The firing of the electrode may be performed at a temperature from 800° C. to 1400° C.

The method may further include forming an additional electrode on a surface of the electrode to precisely adjust resistance.

The method may further include forming a protective layer partially covering the resistor and the electrode.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1A:
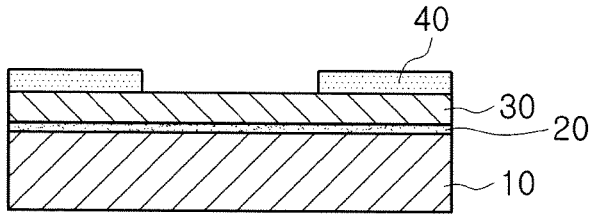
FIGS. 1A to 1C are cross-sectional views of chip resistors according to embodiments of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of elements maybe exaggerated for clarity, and the same reference numerals will be used throughout to designate the same or like elements.

Figure 1B:
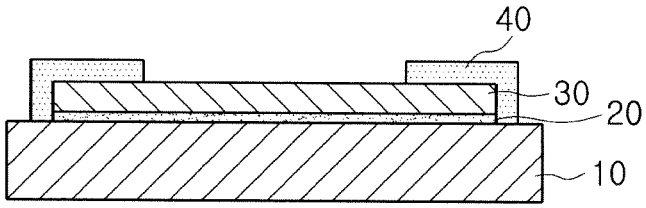
Figure 1C:
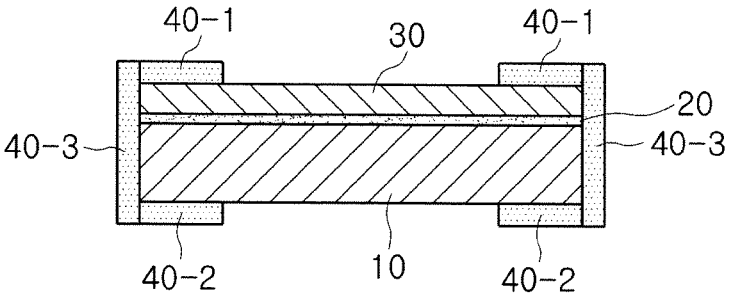

FIGS. 1A to 1C are cross-sectional views of chip resistors according to embodiments of the present invention.

FIG. 1A is a cross-sectional view of a chip resistor in which electrodes 40 are only formed on portions of an upper surface of a resistor 30, according to an embodiment of the present invention.

Referring to FIG. 1A, the chip resistor may include a resistor substrate 10, an adhesion portion 20, the resistor 30, and the electrodes 40.

The resistor substrate 10 is a component for mounting the resistor 30 thereon. The resistor substrate 10 may refer to an insulating substrate formed of a ceramic material. The resistor substrate 10 may be, but is not limited to, an alumina ($Al_2O_3$) substrate.

The resistor substrate 10 may not be particularly limited as long as the resistor substrate 10 may be formed of a material having excellent insulating properties, excellent heat dissipation properties, and excellent adhesive properties with the resistor 30.

The adhesion portion 20 may be formed on a surface of the resistor substrate 10. The adhesion portion 20 is a component for adhering the resistor substrate 10 and the resistor 30 to each other. The adhesion portion 20 may include copper (Cu), nickel (Ni), copper-nickel (Cu—Ni), or the like. The adhesion portion 20 may include a glass material. During a sintering process, the glass material included in the adhesion portion 20 functions as an adhesive for increasing adhesion with the resistor substrate 10.

The adhesion portion 20 may be formed of a similar material to the resistor 30, and thus, heat generated by the resistor 30 may be easily dissipated by the resistor substrate 10. For example, since the adhesion portion 20 includes Cu, Ni, Cu—Ni, or the like, heat generated by the resistor 30 may be smoothly dissipated by the resistor substrate 10.

Since the adhesion portion 20 is formed of a similar material to the resistor 30, adhesion and resistance may be stably maintained, even in a high-temperature environment.

Since an adhesive paste, that is, the adhesion portion 20, includes Cu, Ni, Cu—Ni, or the like, the chip resistor may have improved heat dissipation properties.

The resistor 30 may be formed on the adhesion portion 20.

The resistor 30 may be formed of metal foil since the chip resistor is generally used for detection.

When the resistor 30 is formed of metal foil, a low level of resistance equal to or less than 100 mΩ may be obtained. In addition, since metal foil is used as the resistor 30, a high amount of current may be supplied, compared with the size of the chip resistor.

According to an embodiment of the present invention, the resistor 30 may include copper-nickel (Cu—Ni), copper-nickel-manganese (Cu—Ni—Mn), nickel-chromium (Ni—Cr), or the like.

This is because if the resistor is formed of a material having a low temperature coefficient, such as constantan, manganin, nichrome, or the like, a temperature coefficient of resistivity (TCR) may be increased, in general.

When the resistor 30 includes Cu—Ni—Mn, resistance according to temperature maybe improved, compared with a case in which the resistor 30 includes Cu—Ni.

When the resistor 30 includes Ni—Cr, a high level of resistance may be obtained, compared with a case in which the resistor 30 includes Cu—Ni.

The adhesion portion 20 and the resistor 30 may be alloyed with each other via an ionic diffusion junction to be coupled and adhered to each other.

That is, according to the embodiment of the present invention, since the adhesion portion 20 includes Cu, Ni, Cu—Ni, or the like, adhesion may be improved compared with a conventional method of using an epoxy resin.

The electrodes 40 may be formed on a surface of the resistor 30. The electrodes 40 may include Cu or a Cu alloy. This is because it is also necessary to reduce resistance in the electrodes 40 in order to obtain low resistance in the chip resistor.

According to the embodiment of the present invention, the electrodes 40 may be formed via electrode paste printing.

When the electrodes 40 are formed via electrode paste printing, the thickness of the electrode 40 may be precisely controlled. Also, a target resistance may be easily obtained in the electrode 40.

In addition, when the electrodes 40 are formed via electrode paste printing, a trimming process may be performed on the electrodes 40 formed on the substrate, and thus, a chip resistor having high precision may be manufactured.

FIG. 1B is a cross-sectional view of a chip resistor in which the electrodes 40 are formed on upper and lateral surfaces of the resistor 30, according to another embodiment of the present invention.

Referring to FIG. 1B, the electrodes 40 may be formed from portions of the upper surface of the resistor 30 and the lateral surface of the resistor 30 to portions of an upper surface of the resistor substrate 10.

The detailed description of the chip resistor shown in FIG. 1A is applied to the chip resistor shown in FIG. 1B except for the shape of the electrode 40, and thus, a detailed description of the chip resistor of FIG. 1B will be omitted.

FIG. 1C is a cross-sectional view of a chip resistor in which electrodes are formed from portions of the upper surface of the resistor 30 to a lower surface of the resistor substrate 10, according to another embodiment of the present invention.

Referring to FIG. 1C, the electrodes maybe formed from the portions of the upper surface of the resistor 30 and a lateral surface of the resistor 30 to the lower surface of the resistor substrate 10.

According to the present embodiment, the resistor 30 may be formed on the upper surface of the resistor substrate 10, upper electrodes 40-1 maybe formed on the portions of the upper surface of the resistor 30, and lower electrodes 40-2 may be formed on portions of the lower surface of the resistor substrate 10. In addition, lateral electrodes 40-3 may be formed to electrically connect the upper electrodes 40-1 and the lower electrodes 40-2 to each other.

The detailed description of the chip resistor shown in FIG. 1A is applied to the chip resistor shown in FIG. 1C except for the shape of the electrode 40, and thus, a detailed description of the chip resistor of FIG. 1C will be omitted.

Likewise, according to the above-described embodiments of the present invention, the structure of the electrode 40 and the coupling structure between the resistor substrate 10 and the resistor 30 may be appropriately modified if necessary.

Figure 2:
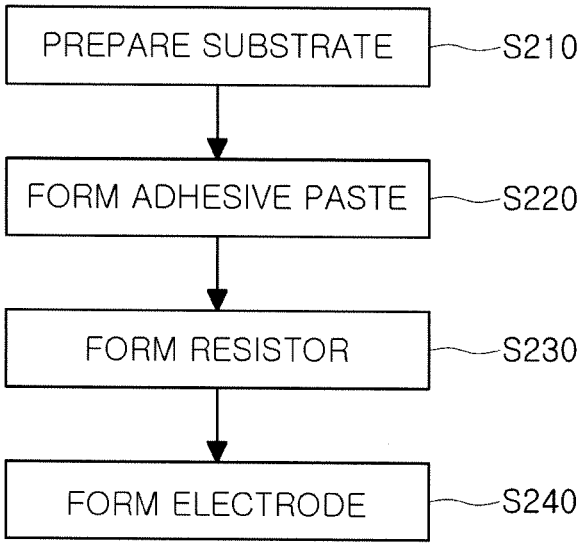
FIG. 2 is a flowchart of a method of manufacturing a chip resistor according to an embodiment of the present invention.

FIG. 2 is a flowchart of a method of manufacturing a chip resistor according to an embodiment of the present invention. FIGS. 3A to 3F are cross-sectional views for explaining the method of manufacturing the chip resistor of FIG. 2.

Figure 3A:
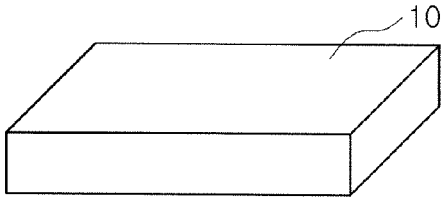
FIGS. 3A to 3F are cross-sectional views for explaining the method of manufacturing the chip resistor of FIG. 2.

The manufacturing method according to the present embodiment may include preparing the resistor substrate 10 (S210), as shown in FIG. 3A.

The resistor substrate 10 may refer to an insulating substrate formed of a ceramic material. The resistor substrate 10 may be, but is not limited to, an alumina ($Al_2O_3$) substrate.

Figure 3B:
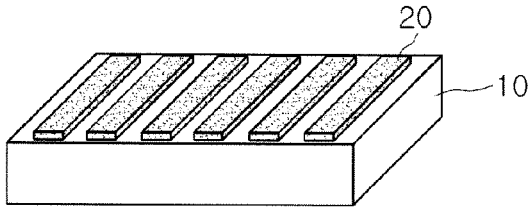

The manufacturing method according to the present embodiment may include printing an adhesive paste (S220), as shown in FIG. 3B.

The adhesive paste is a component for adhering the resistor substrate 10 and the resistor 30 to each other.

The adhesive paste may include Cu, Ni, Cu—Ni, or the like.

Due to Cu, Ni, or Cu—Ni included in the adhesive paste, an ionic diffusion junction may occur between the resistor 30 and the adhesive paste, and the resistor 30 and the adhesive paste may be alloyed to be coupled and adhered to each other.

The adhesive paste may include a glass material.

The glass material included in the adhesive paste increases the adhesion with the resistor substrate 10.

Figure 4A:
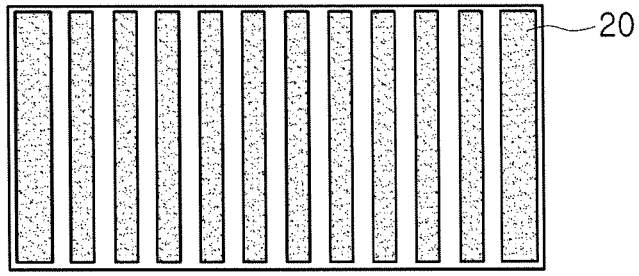
FIGS. 4A and 4B are diagrams of adhesive paste patterns according to embodiments of the present invention.
Figure 4B:
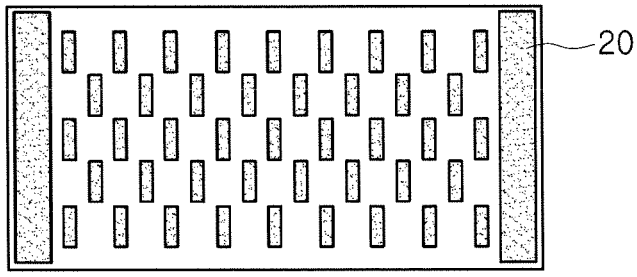

FIGS. 4A and 4B are diagrams of adhesive paste patterns according to embodiments of the present invention.

As shown in FIG. 4A, the adhesive paste may be printed in a stripe pattern.

As shown in FIG. 4B, the adhesive paste may be printed in a lattice pattern.

Likewise, in order to smoothly discharge residue coal generated during firing in a reduction atmosphere, the adhesive paste may be formed in various printing patterns.

That is, the printing pattern of the adhesion paste may be appropriately modified if necessary.

Figure 3C:
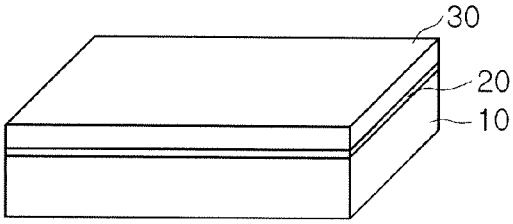

The manufacturing method according to the present embodiment may include forming the resistor 30 (S230), as shown in FIG. 3C.

The resistor 30 may include Cu—Ni, Cu—Ni—Mn, Ni—Cr, or the like.

According to the embodiment of the present invention, the resistor 30 may be stacked on the adhesive paste.

In this case, the resulting structure may be fired. In detail, the firing process may be performed in a reduction atmosphere in order to prevent oxidation.

According to the embodiment of the present invention, a firing temperature may be in a range of 800° C. to 1400° C.

When the firing process is performed, the resistor 30 and the adhesive paste may be alloyed with each other via an ionic diffusion junction to be coupled and adhered to each other, thereby increasing adhesion.

Figure 3D:
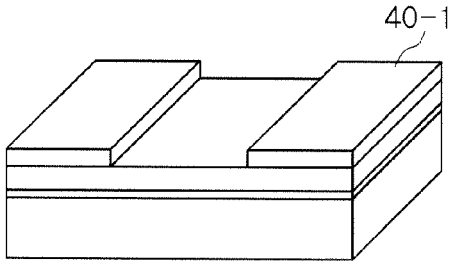

The manufacturing method according to the present embodiment may include forming electrodes 40-1 (S240), as shown in FIG. 3D.

The electrodes 40-1 may include Cu. For example, an electrode paste including Cu may be coated on a surface of the resistor 30 to form the electrodes 40-1. In detail, process efficiency may be increased by using an electrode paste in the same firing conditions as those of the adhesive paste.

According to the embodiment of the present invention, the electrode paste may be formed on the surface of the resistor 30 via screen printing to form the electrodes 40-1, and thus, thickness distribution of the electrodes 40-1 may be reduced.

In addition, the electrodes 40-1 may be formed via screen printing using the electrode paste, and thus, a distance between the electrodes 40-1 may be easily controlled and the thickness of the electrodes 40-1 may be easily controlled.

For example, the method of forming the electrodes 40-1 via screen printing using the electrode paste may also be used to manufacture a chip resistor having a size of (16×8) $mm^2$ or less.

In this manner, the electrodes 40-1 may be formed by coating the electrode paste, such that the film thickness of the electrodes 40-1 may be precisely controlled.

If a method of forming an electrode via plating is used, since a Cu rack plating process is used, metal foils are inevitably electrically connected to each other. Thus, when components are separated from each other in the form of a chip, additional processes for cutting connectors are required.

On the other hand, according to the embodiment of the present invention, since electrodes are separately formed for individual chip resistors, such additional processes may be omitted.

In a method of forming an electrode having a clad structure, an additional process for abrading the electrode is required to change resistance.

On the other hand, according to the embodiment of the present invention, since a distance between the electrodes may be easily controlled by using a screen mask, such an electrode abrading process may be omitted.

According to the embodiment of the present invention, the electrode paste may be printed on the resistor 30 and then the electrode paste may be fired.

Conventionally, with regard to a chip resistor using a resin adhesive, when an electrode is fired during the formation of the electrode, the resin may melt.

However, according to the embodiment of the present invention, the resistor substrate 10 and the resistor 30 are adhered to each other via the adhesive paste including at least one of Cu and Ni. Thus, even in the case that the electrode paste is fired, a problem may not arise in terms of adhesion between the resistor substrate 10 and the resistor 30.

According to the embodiment of the present invention, since the electrode paste is printed and fired to form electrodes, the resistor 30 and the electrode 40 may be alloyed with each other via the ionic diffusion junction, thereby increasing adhesion.

According to the embodiment of the present invention, the firing temperature may be in the range of 800° C. to 1400° C.

Since the electrode paste is printed and fired to form the electrodes, recrystallization between the resistor 30 and the electrode 40 proceeds and grain growth occurs, whereby electrical conductivity may be increased. Thus, low resistance may be obtained in the chip resistor.

The printing and firing processes of the electrode paste maybe repeated several times in order to obtain a predetermined amount of resistance.

Thus, until the predetermined amount of resistance is obtained, the printing and firing processes of the electrode paste may be repeated.

Figure 5A:
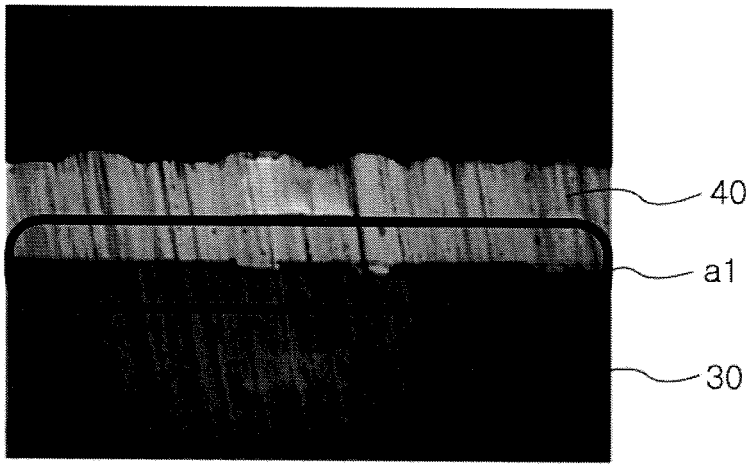
FIGS. 5A and 5B are optical microscope images of an adhesion surface between a resistor and an electrode, according to an embodiment of the present invention.
Figure 5B:
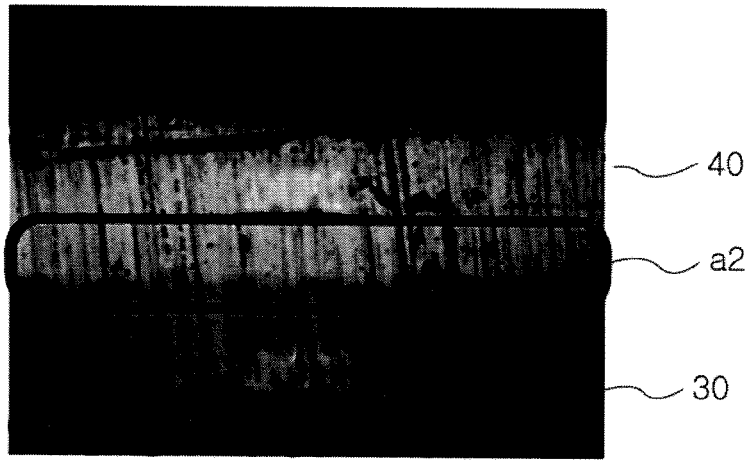

FIGS. 5A and 5B are optical microscope images of adhesion surfaces between the resistor and the electrode, according to an embodiment of the present invention.

FIG. 5A is an optical microscope image of an adhesion surface a1 between the resistor 30 and the electrode 40 before the electrode 40 is fired.

FIG. 5B is an optical microscope image of an adhesion surface a2 between the resistor 30 and the electrode 40 after the electrode 40 is fired.

As shown in FIGS. 5A and 5B, the resistor 30 and the electrode 40 maybe integrated with each other via a firing process. That is, since the resistor 30 and the electrode 40 are alloyed with each other via the ionic diffusion junction, the adhesion between the resistor 30 and the electrode 40 may be increased.

Figure 3E:
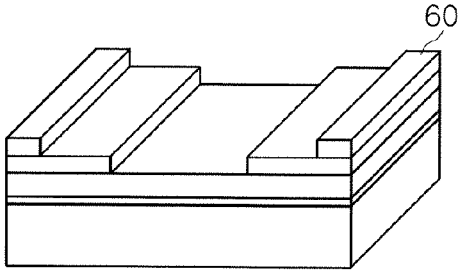

According to an embodiment of the present invention, as shown in FIG. 3E, additional electrodes 60 maybe formed on a surface of the electrode 40.

The additional electrodes 60 are provided to precisely control resistance.

That is, the resistance of the chip resistor may be precisely controlled by the additional electrodes 60. In this case, the size and shape of the additional electrodes 60 may be appropriately modified in order to control resistance.

The method of forming the electrodes 40 may also be used to form the additional electrodes 60, and thus, a detailed description of a method of forming the additional electrodes 60 will be omitted.

The resistance of the chip resistor may be precisely controlled by repeating the coating/firing process of the electrodes 40 and forming the additional electrodes 60.

After the electrodes 40 are formed, resistance may be adjusted by laser dicing, laser-scribing, sand bursting, or the like.

In addition, after the electrodes 40 are formed, as resistance is measured via a probe, the resistance may be adjusted.

Likewise, when the resistance is adjusted while being measured, the resistance may be more precisely controlled.

Figure 3F:
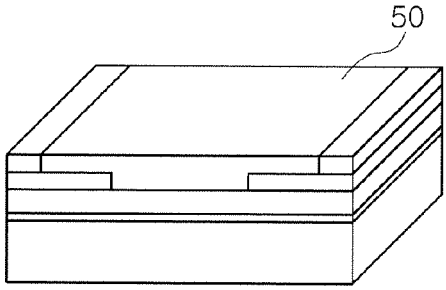

According to an embodiment of the present invention, as shown in FIG. 3F, a protective layer 50 may be formed to partially cover the resistor 30 and the electrodes 40.

The protective layer 50 may be formed of epoxy, a phenol resin, a glass material, or the like.

As set forth above, according to embodiments of the present invention, a chip resistor having improved heat dissipation properties and a method of manufacturing the chip resistor may be provided.

Moreover, a chip resistor including electrodes, thicknesses of which are precisely controlled and a method of manufacturing the chip resistor may be provided.

In addition, a chip resistor able to accurately adjust a target resistance and a method of manufacturing the chip resistor may be provided.

While the present invention has been shown and described in connection with the embodiments, it will be apparent to those skilled in the art that modifications and variations can be made without departing from the spirit and scope of the invention as defined by the appended claims.

What is claimed is:

1. A chip resistor, comprising:

a ceramic substrate;

an adhesion portion formed on a surface of the ceramic substrate; and a resistor formed on the adhesion portion, wherein the adhesion portion includes a glass material and at least one of copper (Cu), nickel (Ni), and copper-nickel (Cu—Ni), and wherein the adhesion portion is formed in a stripe pattern or a lattice pattern.

2. The chip resistor of claim 1, wherein the resistor includes at least one of copper-nickel (Cu—Ni), copper-nickel-manganese (Cu—Ni—Mn), and nickel-chromium (Ni—Cr).

3. The chip resistor of claim 1, further comprising an electrode formed on a surface of the resistor.

4. The chip resistor of claim 3, further comprising an additional electrode formed on a surface of the electrode to precisely adjust resistance.

5. The chip resistor of claim 3, further comprising a protective layer partially covering the resistor and the electrode.

6. A method of manufacturing a chip resistor, the method comprising:

preparing a ceramic substrate;

printing an adhesive paste including a glass material and at least one of copper (Cu), nickel (Ni), and copper-nickel (Cu—Ni) on a surface of the ceramic substrate in a stripe pattern or a lattice pattern; and forming a resistor on an upper surface of the adhesive paste.

7. The method of claim 6, wherein the resistor includes at least one of copper-nickel (Cu—Ni), copper-nickel-manganese (Cu—Ni—Mn), and nickel-chromium (Ni—Cr).

8. The method of claim 6, further comprising forming an electrode by printing an electrode paste on a surface of the resistor.

9. The method of claim 8, further comprising firing the electrode.

10. The method of claim 9, wherein the firing of the electrode is performed at a temperature from 800° C. to 1400° C.

11. The method of claim 9, further comprising forming an additional electrode on a surface of the electrode to precisely adjust resistance.

12. The method of claim 8, further comprising forming a protective layer partially covering the resistor and the electrode.

* * * * *